US005885171A

United States Patent [19]

Sharpe

[11] Patent Number: 5,885,171

[45] Date of Patent: Mar. 23, 1999

[54] SYSTEM FOR ALTERING THE COEFFICIENT OF FRICTION BETWEEN A GOLF CLUB FACE AND A GOLF BALL

[76] Inventor: Gary D. Sharpe, 2700 Ann Ct., Lawrence, Kans. 66046

[21] Appl. No.: 804,156

[22] Filed: Feb. 20, 1997

Related U.S. Application Data

[60] Provisional application No. 60/032,200, Dec. 2, 1996.

[51] Int. Cl.[6] ..... A63B 0/00

[52] U.S. Cl. ..... 473/330; 473/409

[58] Field of Search ..... 473/236, 237, 473/324, 330, 331, 329, 219, 223, 349, 409

[56] References Cited

U.S. PATENT DOCUMENTS

| | | | |
|---|---|---|---|
| 3,754,764 | 8/1973 | Manheck | 473/237 |
| 3,806,132 | 4/1974 | Brandell | 473/237 |
| 3,989,861 | 11/1976 | Rasmussen | 473/330 |
| 4,519,612 | 5/1985 | Tsao | 473/243 |
| 4,676,508 | 6/1987 | Dilny | 473/237 |
| 4,917,384 | 4/1990 | Caiati | 473/330 |
| 4,974,851 | 12/1990 | Closser | 473/237 |
| 5,033,746 | 7/1991 | Jones | 473/237 |
| 5,142,309 | 8/1992 | Lee | 473/237 |
| 5,531,444 | 7/1996 | Buettner | 473/349 |

*Primary Examiner*—Sebastiano Passaniti
*Attorney, Agent, or Firm*—Hovey, Williams, Timmons & Collins

[57] ABSTRACT

A system for changing the trajectory of the golf ball when struck by the face of a golf club includes a coating of friction altering material applied to the club face. In one embodiment, the friction altering material includes a lubricant for reducing the side spin imparted to the ball struck by the club face thereby reducing the amount of hook or slice in the trajectory of the ball. In another embodiment a friction-increasing material such as an adhesive is used for increasing the amount of hook or slice.

2 Claims, 1 Drawing Sheet

SYSTEM FOR ALTERING THE COEFFICIENT OF FRICTION BETWEEN A GOLF CLUB FACE AND A GOLF BALL

RELATED APPLICATIONS

This application claims priority under 35 U.S.C. § 119(e) of Provisional Application Ser. No. 60/032,200, filed Dec. 2, 1996 entitled METHOD OF CHANGING THE FRICTION OF THE FACE OF A GOLF CLUB.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of golf. In particular, the invention is concerned with a system for changing the trajectory of the golf ball when struck by the face of a golf club by applying a coating friction altering material to the club face.

2. Description of the Prior Art

As golfers are well aware, an unwanted hook or slice when hitting the golf ball can be detrimental to the enjoyment of the game. A hook or slice is generally the result of side spin imparted to the ball during impact. This spin occurs when the club face is not perpendicular to the arc of the swing. The greater the deviation from perpendicular, the greater the resulting spin and resulting hook or slice. The prior art has addressed this problem by changing the surface characteristics of the golf ball. This technique has produced mixed results.

SUMMARY OF THE INVENTION

The present invention solves the prior art problems discussed above and provides a distinct advance in the state of the art. In particular, the system hereof provides an efficient and economical way to alter the trajectory of a golf ball.

In the preferred embodiment, the trajectory of a golf ball is changed by applying a friction altering substance to the club face prior to striking the ball. In one embodiment, a coating of friction reducing material such as a lubricant is applied to the club face. This reduces the coefficient of friction between the club face of the golf ball when struck thereby reducing the amount of side spin and the resultant hook or slice. In another embodiment, a friction increasing material is applied to the club face.

DETAILED DESCRIPTION OF THE PREFERRED EMBODIMENT

Figure 1:
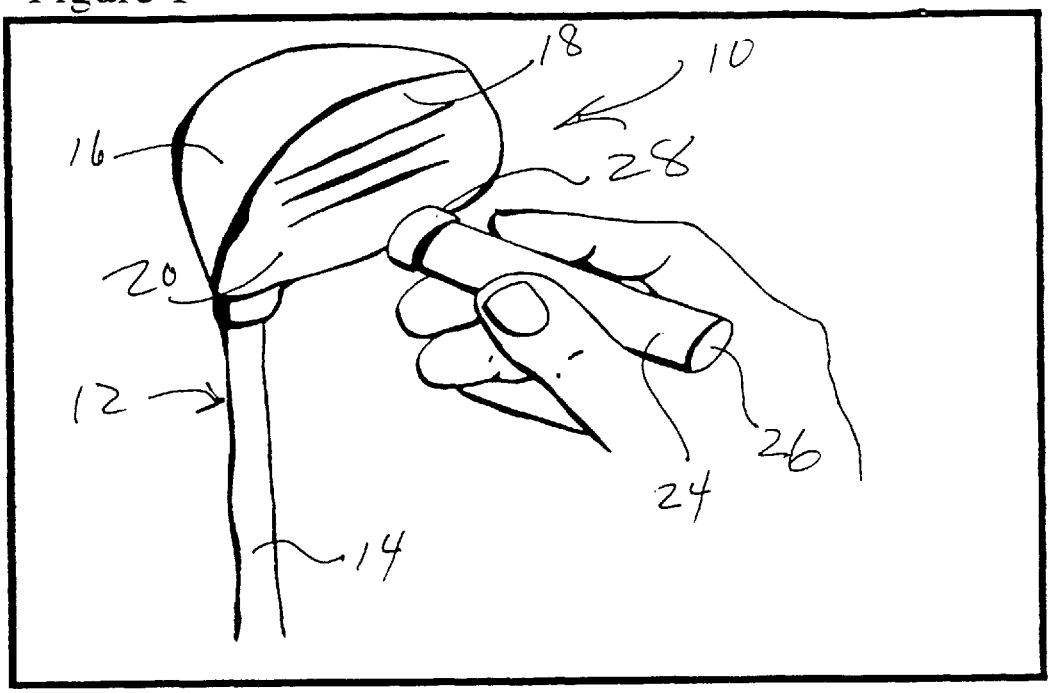
FIG. 1 illustrates the head of a golf club and a portion of the shaft thereof after application of a coating of friction altering material to the club face by an applicator in accordance with the present invention.

FIG. 1 illustrates combination 10 in accordance with the present invention. In particular, combination 10 includes golf club 12 having shaft 14, club head 16 connected to one end of shaft 14, and club face 18, with coating 20 of friction altering material applied to face 18. In preferred forms, the friction-altering material is in the form of a liquid so that is can be conveniently dispensed from an applicator such as applicator 22 illustrated in FIG. 1, and so that the material, once applied, spreads to a generally uniform and even coating.

In one embodiment, coating 20 is composed of a friction-reducing material, preferably silicone dioxide. It will also be appreciated that other friction-reducing materials can be used including silicone, silicates, PTFE, petroleum derivatives, waxes, plastics and water-based lubricants. Other lubricants can also be used.

In another embodiment, the friction altering material is a friction-increasing material. Such materials can include adhesives such as pressure sensitive adhesives, low tack adhesive, temporary adhesives and temperature sensitive adhesives.

Preferred applicator 22 includes tubular body 24 having one end thereof closed by end wall 26 and the other end terminating in applicator sponge 28. In preferred forms, sponge 28 can be enclosed in a cap (not shown) configured for threadable coupling with body 24. The interior of body 24 holds a supply of the preferred friction-altering material in liquid form. Applicator 22 also includes a conventional interior valve (not shown) with the valve stem thereof recessed slightly below the exposed surface of sponge 28. Pressure on sponge 28 also applies pressure to the valve stem thereby opening the valve and allowing the friction-altering material to flow into sponge 28.

Figure 2:
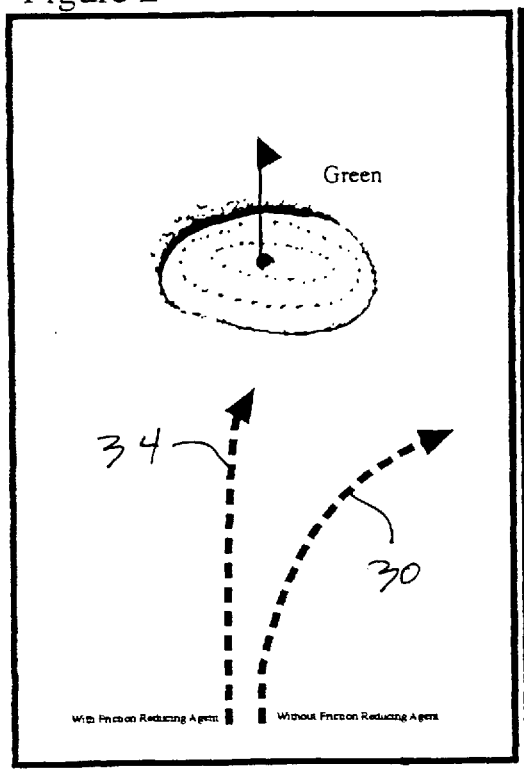
FIG. 2 illustrates the effect of reduced slice on a golf ball as a result of a coating of friction reducing material to the face of the club of FIG. 1.

In use, the golfer first decides whether to use a friction-reducing or friction-increasing material as coating 20 on club face 18 for the impending golf shot. If the golfer has a tendency toward an unwanted slice or hook as illustrated by slice track 30 (FIG. 2) and hook track 32 (FIG. 3), then the golfer would select the friction-reducing material.

Using applicator 22 with friction-reducing material contained therein, the golfer removes the cap and applies sponge 28 to club face 18 with sufficient pressure to open the interior valve and release the liquid material into sponge 28. The golfer then rubs club face 18 with sponge 28 until an even coating of material is applied thereto.

With coating 20 in place on club face 18, the golfer then swings golf club 12 at a golf ball presented on a support surface with the golf swing properly configured so that club face 18 strikes the ball. If no hook or slice is desired, the golfer attempts to control the swing so that club face 18 is perpendicular to the arc of the swing upon impact of the ball. Such an ideal is not always attained, resulting in a slice or hook as illustrated by tracks 30 and 32 in FIGS. 2 and 3.

Figure 3:
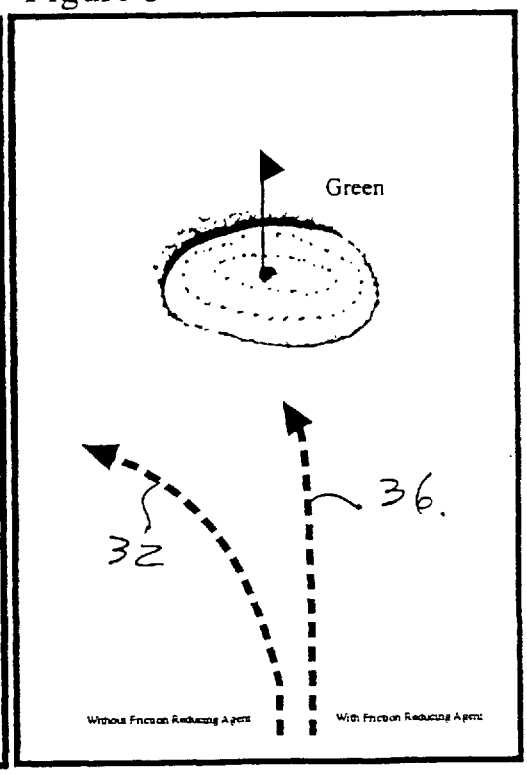
FIG. 3 illustrates the effect of reduced hook on a golf ball as a result of a coating of friction reducing material to the face of the club of FIG. 1.

With friction-reducing coating 20, however, the coefficient of friction is reduced between club face 18 and the ball. As a result, less side spin in imparted to the ball due to any deviation from perpendicular. With less side spin, any resulting slice or hook is also reduced as illustrated by slice track 34 (FIG. 2) or hook track 36 (FIG. 3). Thus, the golfer is able to alter the trajectory of the ball by applying friction-altering coating 20 to club face 18 prior to striking the ball.

In some circumstances, the golfer may desire to increase a slice or a hook. Such might be the case with a dog leg right or left. Accordingly, a friction-increasing material would be used as coating 20 on club face 18 using the procedure discussed above.

Having thus described the preferred embodiment of the present invention, the following is claimed as new and desired to be secured by Letters Patent:

1. A method of changing the trajectory of a golf ball comprising the steps of:

(a) swinging a golf club in a manner so that the club face strikes a golf ball positioned on a support surface, there being a coefficient of friction between said club face and said ball during impact and a tendency for said club face to impart side spin to said ball as a result of said coefficient of friction, whereby said spin is a factor in determining the trajectory of said ball; and (b) changing said side spin and thereby the trajectory of said ball by altering said coefficient of friction by manually applying a coating of liquid, friction altering material from a hand-held dispenser to said club face prior to step (a), step (b) including the step of altering said coefficient of friction by applying said coating consisting of friction-lowering material to said club face thereby reducing the amount of spin imparted to said ball when struck by said club face, step (b) further including the step of applying said friction-lowering material selected from the group consisting of silicone dioxide, silicone, silicate, and petroleum-derived lubricant.

2. The method as set forth in claim 1, step (b) including the step of applying silicone dioxide as said friction-lowering material.

* * * * *